US007900591B2

(12) United States Patent
Roerig et al.

(10) Patent No.: US 7,900,591 B2
(45) Date of Patent: Mar. 8, 2011

(54) SWITCHABLE COMPONENT FOR A VALVE TRAIN OF AN INTERNAL COMBUSTION ENGINE

(75) Inventors: Bodo Roerig, Weisendorf (DE); Joachim Seitz, Reundorf (DE); Robert Heinemann, Herzogenaurach (DE)

(73) Assignee: Schaeffler KG, Herzogenaurach (DE)

( * ) Notice: Subject to any disclaimer, the term of this patent is extended or adjusted under 35 U.S.C. 154(b) by 275 days.

(21) Appl. No.: 12/248,263

(22) Filed: Oct. 9, 2008

(65) Prior Publication Data

US 2009/0095240 A1 Apr. 16, 2009

Related U.S. Application Data

(60) Provisional application No. 60/978,893, filed on Oct. 10, 2007.

(51) Int. Cl.
*F01L 1/14* (2006.01)

(52) U.S. Cl. ..... 123/90.5; 123/90.55; 123/90.48

(58) Field of Classification Search ..... 123/90.16, 123/90.52, 90.55, 90.5, 90.48, 90.59
See application file for complete search history.

(56) References Cited

U.S. PATENT DOCUMENTS

| | | | | |
|---|---|---|---|---|
| 4,089,234 | A | 5/1978 | Henson et al. | |
| 5,263,386 | A | 11/1993 | Campbell et al. | |
| 5,307,769 | A | 5/1994 | Meagher et al. | |
| 6,595,174 | B2 * | 7/2003 | Schnell | 123/90.55 |

FOREIGN PATENT DOCUMENTS

| | | | |
|---|---|---|---|
| DE | 101 19 366 | Y | 10/2002 |
| DE | 10 2006 007 489 | Y | 9/2006 |

* cited by examiner

*Primary Examiner* — Zelalem Eshete
(74) *Attorney, Agent, or Firm* — Lucas & Mercanti, LLP

(57) ABSTRACT

The invention proposes a switchable component (1) for a valve train of an internal combustion engine, said component (1) comprising a housing (2) in whose bore (3) an axially displaceable inner element (4) comprising coupling elements (5) is received, said coupling elements (5), for effecting coupling, being able to be brought partially into engagement with an entraining surface (6) of the housing (2), the inner element (4) being biased in outward direction from the housing (2) by a lost motion spring (7), and an (outer) anti-rotation device (11) extending from an outer casing (10) of the housing (2) projects beyond a surrounding structure (12*a*), the outer anti-rotation device (11) is configured as a C-shaped, thin-walled ring (13) comprising a slit (12), said ring (13) extends after the manner of a clip in an annular groove (14) in the outer casing (10) of the housing (2) parallel to a transversal plane of the component (1) and, for effecting outer anti-rotation, said ring (13) projects with a sickle-like portion (15) of its outer peripheral surface (16) beyond the outer casing (10) of the housing (2).

9 Claims, 2 Drawing Sheets

SWITCHABLE COMPONENT FOR A VALVE TRAIN OF AN INTERNAL COMBUSTION ENGINE

FIELD OF THE INVENTION

The invention concerns a switchable component for a valve train of an internal combustion engine, said component comprising a housing in whose bore an axially displaceable inner element comprising coupling elements is received, said coupling elements, for effecting coupling [axially distant relative position of the inner element to the housing], being able to be brought partially into engagement with an entraining surface of the housing, the inner element being biased in outward direction from the housing by a lost motion spring, an axially fully extended position of the inner element being defined by an upper vertical stop means overlapping an annular gap between the inner element and the housing, in which extended position, a coupling position of the coupling elements with coupling lash relative to an entraining surface of the coupling elements is created, and an (outer) anti-rotation device extending from an outer casing of the housing projects beyond a surrounding structure.

BACKGROUND OF THE INVENTION

A component of the pre-cited type, configured, for instance, as a switchable support element is sufficiently well-known in the technical field. The outer anti-rotation device can be configured, for example, as a pin or the like that is pressed into a reception of an outer casing of the housing and cooperates with a corresponding groove of a surrounding structure (cylinder head). It is clear to a person skilled in the art that this interference fit can get disengaged during operation of the valve train. In addition, this pressing-in is accompanied by an undesired introduction of force into the surrounding material. Furthermore, under certain circumstances, said pin cannot be removed in case of a "faulty pressing".

The aforesaid outer anti-rotation device is required, for example, if it is desired to realize a supply of hydraulic medium, for example, to the at least one coupling element or to a lash adjuster integrated in the component, without having recourse to annular grooves on the outer casing of the housing or in the reception bore of the cylinder head which makes an exact relative positioning of the hydraulic medium channels to each other necessary.

OBJECTS OF THE INVENTION

It is an object of the invention to provide a component of the pre-cited type in which the aforesaid drawbacks are eliminated with simple measures.

SUMMARY OF THE INVENTION

The invention achieves the above objects by the fact that the outer anti-rotation device is configured as a C-shaped, thin-walled ring comprising a slit, said ring extends after the manner of a clip in an annular groove in the outer casing of the housing parallel to a transversal plane of the component and, for effecting (outer) anti-rotation, said ring projects with a sickle-like portion of an outer peripheral surface beyond the outer casing of the housing, and a remaining outer peripheral portion of said ring does not protrude beyond the outer casing of the housing.

In this way, the aforesaid drawbacks are effectively eliminated. The switchable component is typically a switchable support element or a switchable roller-type or mushroom-type tappet; however, if appropriate, the component can also be a cup tappet or the like.

The slit, thin-walled ring (C-shaped or, if required, U-shaped) proposed by the invention can be manufactured extremely economically and, due to its arrangement in an annular groove in the outer casing of the housing, it is assured that the ring does not get disengaged or change its position during operation.

Thus, a very easy to mount and an extremely inexpensive outer anti-rotation device (ring) that can serve at the same time as an upper vertical stop means is obtained. Particularly preferably (but not necessarily), this stop means defines at the same time a coupling position of the coupling element with coupling lash relative to its entraining surface. If appropriate, the coupling lash can also be adjusted through other measures, so that only an upper vertical stop means is combined with the outer anti-rotation device in one single component.

For installing the component (e.g. support element) in a reception bore of a surrounding structure (cylinder head), it is only necessary to provide the reception bore with a short counterbore offset from the axis and seat the sickle-like portion of the ring in this counterbore for anti-rotation purposes. The additional machining work required is strongly limited also because the machining direction remains the same. A milling tool or the like may also be used in place of a boring tool.

Further advantageous features of the invention described below can also contain measures that are patentable on their own.

The ring of the invention is thus proposed as a so-called "multi-function" component. If, as proposed above, this ring is to be configured at the same time as an upper vertical stop means, it projects with an appropriate inner peripheral segment through an aperture in the outer casing of the housing, this inner peripheral segment preferably bears against a longitudinal flattened portion on the outer peripheral surface of the inner element, and in the extended position of the inner element, a lower edge of the longitudinal flattened portion cooperates with a lower surface of the inner peripheral segment.

In a further development of the invention, it is proposed to use the ring at the same time as an inner anti-rotation device (inner element relative to the housing). For this purpose, an appropriate inner peripheral segment of the ring again projects through an aperture of the housing, a longitudinal flattened portion is likewise arranged in the outer peripheral surface of the inner element, and for achieving anti-rotation, a complementary surface (key surface) of the inner peripheral segment extends directly on this longitudinal flattened portion. Thus, in this embodiment, the ring is used both for realizing an "outer" and an "inner" anti-rotation device.

According to a further proposition of the invention, the "outer" and the "inner" anti-rotation device as well as the upper vertical stop for defining the coupling position are embodied in the component "ring". Thus, as the person skilled in the art will at once understand, separate components for these functions can be dispensed with.

According to a particularly preferable feature of the invention, the outer peripheral surface of the ring, with the exception of the sickle-shaped portion, should not protrude beyond the outer casing of the housing in the installed state and the ring should possess exactly two inner peripheral segments that are situated opposite each other and enclose the sickle-shaped portion, which sickle-shaped portion should be situated opposite the slit.

The invention further proposes to realize the protruding portion of the ring either through an axis-offset annular groove in the housing or through an eccentric portion of the ring, the second measure being particularly economic to implement from a manufacturing point of view.

For realizing the ring with the above-discussed "multi-functionality", it is possible to have recourse to a mass product and modify this slightly. The ring can be made of a spring steel or the like, but a configuration in a plastic material is also possible.

BRIEF DESCRIPTION OF THE DRAWING

The invention will now advantageously be described more closely with reference to the appended drawing in which.

DETAILED DESCRIPTION OF THE DRAWING

Figure 1:
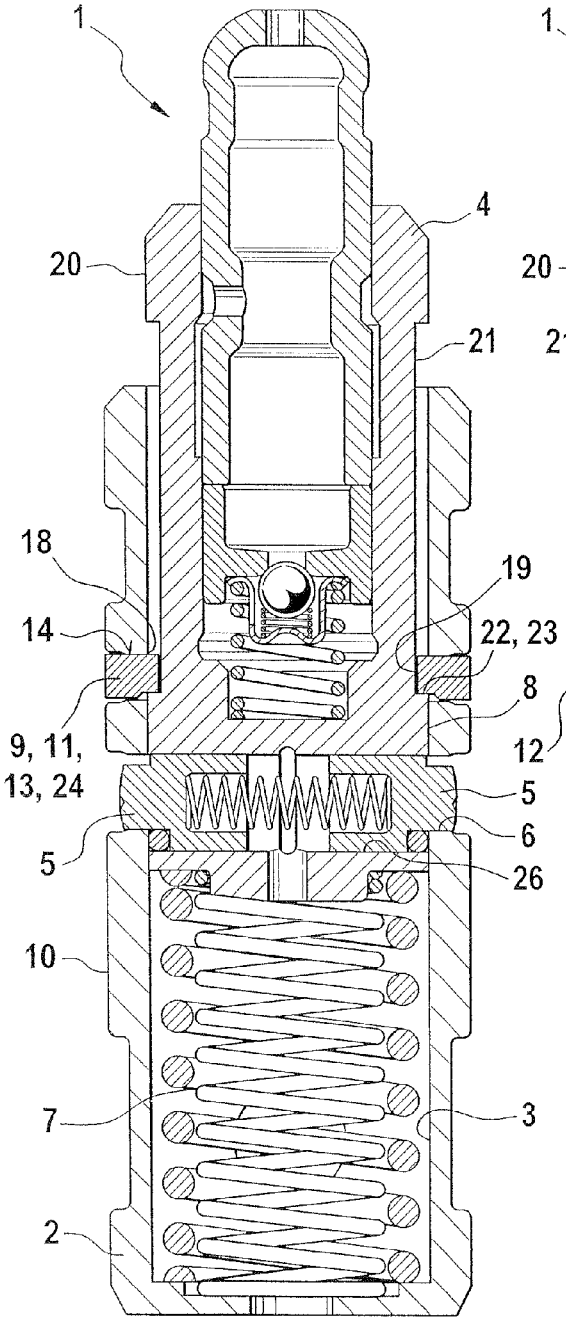
FIG. 1 shows a longitudinal section through a switchable component, in the present example, a support element.

The figures illustrate a switchable component 1, in the present case, a support element, for a valve train of an internal combustion engine. The component 1 comprises a hollow cylindrical housing 2 having a bore 3. An inner element 4 is seated in the bore 3 for axial displacement relative to the housing 2. The inner element 4 is biased in a direction leading out of the housing 2 by a lost motion spring 7 configured in the present case as a coiled compression spring (or a stack of coiled compression springs).

As disclosed in FIG. 1, two coupling elements 5 configured in the form of pistons are situated diametrically opposite each other in a radial bore 26 of the inner element 4. For effecting coupling between the inner element 4 and the housing 2, these coupling elements 5 are displaced into an entraining surface 6 of the housing 2 and partially overlap an annular gap 8 between the housing 2 and the inner element 4. The entraining surface 6 can be constituted, for instance, as an aperture, a segment-like cavity or even an annular groove or the like.

Figure 2:
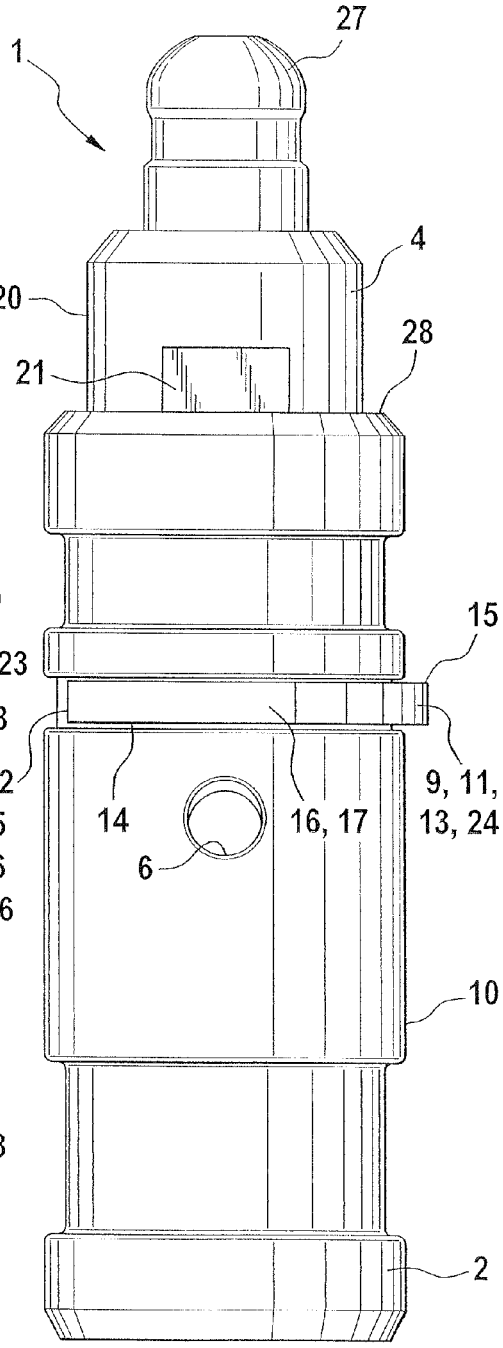
FIG. 2 shows a component similar to the one of FIG. 1, but turned through 90° and not in a sectional view.

In an annular groove 14 made in the outer casing 10 of the housing 2 is seated a C-shaped ring 13. As best seen in FIG. 2, this ring 13 projects with a sickle-shaped portion 15 of its outer periphery 16 beyond the outer casing 10 of the housing 2. The remaining portion of the outer periphery 16 of the ring 13 does not protrude beyond said outer casing 10 of the housing 2. The projecting portion 15 creates an (outer) anti-rotation device for the entire component 1 relative to the surrounding structure 12*a* (cylinder head 30). This ring 13 serves at the same time as an upper vertical stop means 9 and as a means 24 for forming an "inner" anti-rotation device of the inner element 4 relative to the housing 2.

The housing 2 comprises two opposing apertures 18. Through each aperture 18 projects an appropriately configured inner peripheral segment 19 of the ring 13. Complementary surfaces 25 of the ring 13 configured as bowstring-like key surfaces are arranged opposite each other on the inner peripheral segments 19. In the outer peripheral surface 20 of the inner element 4 is arranged facing each of the inner peripheral segments 19, a longitudinal flattened portion 21. The complementary surface 25 of each inner peripheral segment 19 cooperates with a respective one of the longitudinal flattened portions 21. It is thus clear that the aforesaid inner anti-rotation device (means 24) is created through the support of the complementary surface 25 on the opposing longitudinal flattened portion 21. At the same time, when a lower edge 22 of the longitudinal flattened portion 21 comes to abut against a lower surface 23 of the inner peripheral segment 19 in the extended state, the upper vertical stop means 9 becomes operative. This also creates a coupling position of the coupling elements 5 with coupling lash relative to the entraining surface 6 in the housing 2. This coupling lash is adjusted such that its variation over a large number of like components 1 is extremely small.

It is true that the axis of the annular groove 14 for the ring 13 can be configured with an offset, so that the ring 13 projects with its sickle-shaped portion 15 beyond the outer casing 10 of the housing 2. However, for realizing the outer anti-rotation device 11, according to a particularly preferred embodiment, the ring 13 in itself is configured with an appropriate eccentric portion.

Figure 3:
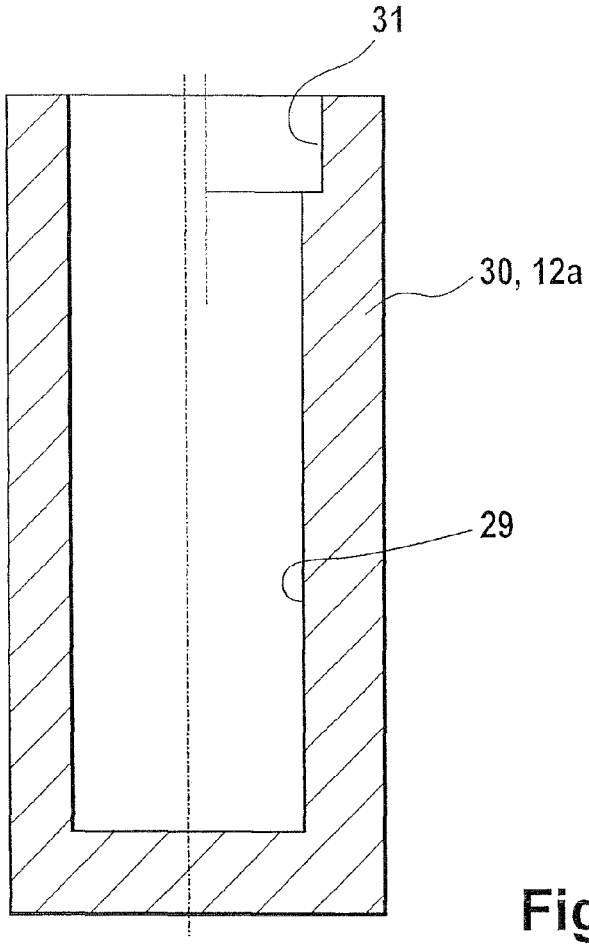
FIG. 3 is a schematic view of a surrounding structure (cylinder head) for the component.
Figure 4:
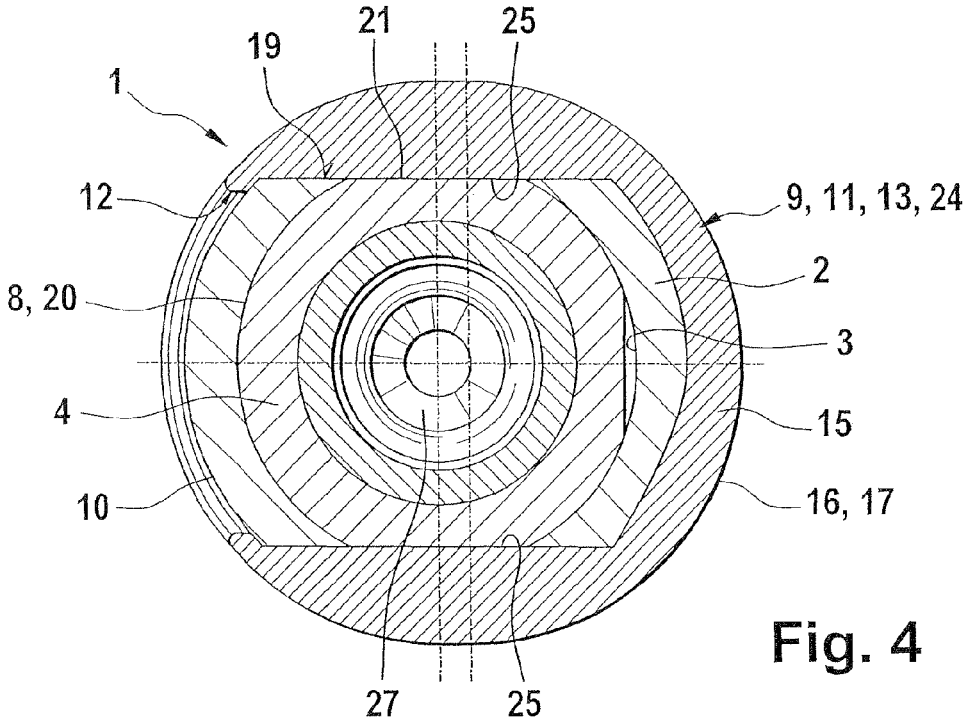
FIG. 4 shows a transversal section through the component of FIG. 1 taken in a region of a ring of the component.

The component 1 disclosed in FIG. 2 can be inserted, according to FIG. 3, into a reception bore 29 of a surrounding structure 12*a* (cylinder head 30), the sickle-shaped portion 15 of the ring 13 for realizing anti-rotation then being seated in a counterbore 31.

LIST OF REFERENCE NUMERALS

1 Component
2 Housing
3 Bore
4 Inner element
5 Coupling element
6 Entraining surface
7 Lost motion spring
8 Annular gap
9 Upper vertical stop means
10 Outer casing of housing
11 (Outer) anti-rotation device
12 Slit
12*a*) Surrounding structure
13 Ring
14 Annular groove
15 Sickle-shaped portion
16 Outer peripheral surface of ring
17 Outer peripheral portion
18 Aperture
19 Inner peripheral segment
20 Outer peripheral surface of inner element
21 Longitudinal flattened portion
22 Lower edge of longitudinal flattened portion
23 Lower surface of inner peripheral segment
24 Means (inner anti-rotation device)
25 Complementary surface
26 Radial bore
27 Head
28 Edge
29 Reception bore
30 Cylinder head
31 Counterbore

The invention claimed is:

1. A switchable component for a valve train of an internal combustion engine, said component comprising:

a housing in whose bore an axially displaceable inner element comprising coupling elements is received, said coupling elements, for effecting coupling axially distant relative position of the inner element to the housing, being able to he brought partially into engagement with an entraining surface of the housing, the inner element being biased in outward direction from the housing by a lost motion spring, an axially fully extended position of the inner element being defined by an upper vertical stop means overlapping an annular gap between the inner element and the housing, in which extended position, a coupling position of the coupling elements with coupling lash relative to the entraining surface of the coupling elements is created, and an anti-rotation device extending from an outer casing of the housing projects beyond a surrounding structure, wherein the outer anti-rotation device is configured as a C-shaped, thin-walled ring comprising a slit, said ring extends in a manner of a clip in an annular groove in the outer casing of the housing parallel to a transversal plane of the component and, for effecting anti-rotation, said ring projects with a sickle-shaped portion of an outer peripheral surface beyond the outer casing of the housing, and a remaining outer peripheral portion of said ring does not protrude beyond the outer casing of the housing, and wherein the ring is configured at the same time as an upper vertical stop means, and the housing comprises at least one aperture through which an appropriate inner peripheral segment of the ring projects, and in an outer peripheral surface of the inner element extends a longitudinal flattened portion or a longitudinal groove, into which the inner peripheral segment engages, and a lower edge of the longitudinal flattened portion/longitudinal groove abuts against a lower surface of the inner peripheral segment for defining the coupling position upper vertical stop means.

2. The component according to claim 1, wherein the component is configured as a support element whose inner element comprises a head that forms a support for a lever-type cam follower by protruding beyond an edge of the housing, and the component can be installed through the outer casing in a reception bore of a cylinder head.

3. The component according to claim 1, wherein the component is configured as one of a roller-type or mushroom-type tappet, a lower surface of the housing is designed for cooperating with a lifting cam and the inner element forms at another end of the component, a support for a tappet pushrod.

4. The component according to claim 1, wherein the sickle-shaped portion of the ring projecting beyond the outer casing of the housing is seated in a counterbore that is eccentric to the reception bore.

5. A switchable component for a valve train of an internal combustion engine, said component comprising:

a housing in whose bore an axially displaceable inner element comprising coupling elements is received, said coupling elements, for effecting coupling axially distant relative position of the inner element to the housing, be able to be brought partially into engagement with an entraining surface of the housing, the inner element being biased in outward direction from the housing by a lost motion spring, an axially fully extended position of the inner element being defined by an upper vertical stop means overlapping an annular gap between the inner element and the housing,in which extended position, a coupling position of the coupling elements with coupling lash relative to the entraining surface of the coupling elements is created, and an anti-rotation device extending from an outer casing of the housing projects beyond a surrounding structure, wherein the outer anti-rotation device is configured as a C-shaped, thin-walled ring comprising a slit, said ring extends in a manner of a clip in an annular groove in the outer casing of the housing parallel to a transversal plane of the component and, for effecting anti-rotation, said ring projects with a sickle-shaped portion of an outer peripheral surface beyond the outer casing of the housing, and a remaining outer peripheral portion of said ring does not protrude beyond the outer casing of the housing, and wherein the ring serves at the same time as a means for anti-rotation of the inner element relative to the housing, the housing comprises at least one aperture through which an appropriate inner peripheral segment of the ring projects, in the outer peripheral surface of the inner element extends one of a longitudinal flattened portion or a longitudinal groove, on or in which, for achieving inner anti-rotation, the inner peripheral segment extends directly with a complementary surface such as a bowstring-like key surface or an extension.

6. A switchable component for a valve train of an internal combustion engine, said component comprising:

a housing in whose bore an axially displaceable inner element comprising coupling elements is received, said coupling elements for effecting coupling axially distant relative position of the inner element to the housing, being able to be brought partially into engagement with an entraining surface of the housing, the inner element being biased in outward direction from the housing by a lost motion spring, an axially fully extended position of the inner element being defined by an upper vertical stop means overlapping an annular gap between the inner element and the housing, in which extended position, a coupling position of the coupling elements with coupling lash relative to the entraining surface of the coupling elements is created, and an anti-rotation device extending from an outer casing of the housing projects beyond a surrounding structure, wherein the outer anti-rotation device is configured as a C-shaped, thin-walled ring comprising a slit, said ring extends in a manner of a clip in an annular groove in the outer casing of the housing parallel to a transversal plane of the component and, for effecting anti-rotation, said ring projects with a sickle-shaped portion of an outer peripheral surface beyond the outer casing of the housing, and a remaining outer peripheral portion of said ring does not protrude beyond the outer casing of the housing, and wherein the ring serves at the same time:

a) as a means for anti-rotation of the inner element relative to the housing, and b) as an upper vertical stop means, the housing comprises at least one aperture through which an appropriate inner peripheral segment of the ring projects, in the outer peripheral surface of the inner element extends one of a longitudinal flattened portion or a longitudinal groove, on or in which, for achieving inner anti-rotation, the inner peripheral segment extends directly with a complementary surface such as a bowstring-like key surface or an extension, and a lower edge of the longitudinal flattened portion/longitudinal groove abuts against a lower surface of the inner peripheral segment for defining the coupling position upper vertical stop means.

7. A switchable component for a valve train of an internal combustion engine, said component comprising:

a housing in whose bore an axially displaceable inner element comprising coupling elements is received, said coupling elements, for effecting coupling axially distant relative position of the inner element to the housing, being able to be brought partially into engagement with an entraining surface of the housing, the inner element being biased in outward direction from the housing by a lost motion spring, an axially fully extended position of the inner element being defined by an upper vertical stop means overlapping an annular gap between the inner element and the housing, in which extended position, a coupling position of the coupling elements with coupling lash relative to the entraining surface of the coupling elements is created, and an anti-rotation device extending from an outer casing of the housing projects beyond a surrounding structure, wherein the outer anti-rotation device is configured as a C-shaped, thin-walled ring comprising a slit, said ring extends in a manner of a clip in an annular groove in the outer casing of the housing parallel to a transversal plane of the component and, for effecting anti-rotation, said ring projects with a sickle-shaped portion of an outer peripheral surface beyond the outer casing of the housing, and a remaining outer peripheral portion of said ring does not protrude beyond the outer casing of the housing, and wherein the sickle-shaped portion of the ring and the slit of the ring are situated diametrically opposite each other, and the ring comprises exactly two inner peripheral segments that enclose the sickle-shaped portion and are situated opposite each other after the manner of key surfaces.

8. A switchable component for a valve train of an internal combustion engine, said component comprising:

a housing in whose bore an axially displaceable inner element comprising coupling elements is received, said coupling elements, for effecting coupling axially distant relative position of the inner element to the housing, being able to be brought partially into engagement with an entraining surface of the housing, the inner clement being biased in outward direction from the housing by a lost motion spring, an axially fully extended position of the inner element being defined by an upper vertical stop means overlapping an annular gap between the inner element and the housing, in which extended position, a coupling position of the coupling elements with coupling lash relative to the entraining surface of the coupling elements is created, and an anti-rotation device extending from an outer casing of the housing projects beyond a surrounding structure, wherein the outer anti-rotation device is configured as a C-shaped, thin-walled ring comprising a slit, said ring extends in a manner of a clip in an annular groove in the outer casing of the housing parallel to a transversal plane of the component and, for effecting anti-rotation, said ring projects with a sickle-shaped portion of an outer peripheral surface beyond the outer casing of the housing, and a remaining outer peripheral portion of said ring does not protrude beyond the outer casing of the housing, and wherein the coupling element is at least one piston which extends in a radial bore of the inner element and which, for effecting coupling, can be displaced into or under the entraining surface of the housing.

9. A switchable component for a valve train of an internal combustion engine, said component comprising:

a housing in whose bore an axially displaceable inner element comprising coupling elements is received, said coupling elements, for effecting coupling axially distant relative position of the inner element to the housing, being able to be brought partially into engagement with an entraining surface of the housing, the inner element being biased in outward direction from the housing by a lost motion spring, an axially fully extended position of the inner element being defined by an upper vertical stop means overlapping an annular gap between the inner element and the housing, in which extended position, a coupling position of the coupling elements with coupling lash relative to the entraining surface of the coupling elements is created, and an anti-rotation device extending from an outer casing of the housing projects beyond a surrounding structure, wherein the outer anti-rotation device is configured as a C-shaped, thin-walled ring comprising a slit, said ring extends in a manner of a clip in an annular groove in the outer casing of the housing parallel to a transversal plane of the component and, for effecting anti-rotation, said ring projects with a sickle-shaped portion of an outer peripheral surface beyond the outer casing of the housing, and a remaining outer peripheral portion of said ring does not protrude beyond the outer casing of the housing, and wherein the sickle-shaped portion of the outer peripheral surface of the ring protruding beyond the outer casing of the housing is realized through one of an axis-offset annular groove in the housing or an eccentric portion of the ring.

* * * * *